United States Patent [19]

Furno et al.

[11] Patent Number: 4,875,035

[45] Date of Patent: Oct. 17, 1989

[54] ARRANGEMENT FOR THE DISPLAY OF PROCESSING DATA BY MEANS OF PIXELS ON A CATHODE RAY TUBE

[75] Inventors: Franco Furno, Zimone; Luigi Biondi, San Martino Canavese, both of Italy

[73] Assignee: Ing. C. Olivetti & C., S.p.A., Ivrea, Italy

[21] Appl. No.: 162,252

[22] Filed: Feb. 29, 1988

[30] Foreign Application Priority Data

Mar. 31, 1987 [IT] Italy ..... 67248 A/87

[51] Int. Cl.[4] ..... G09G 1/16

[52] U.S. Cl. ..... 340/731; 340/811; 340/814; 358/140

[58] Field of Search ..... 340/720, 721, 723, 731, 340/793, 811, 813, 814; 358/83, 86, 140; 273/DIG. 28, 85 G

[56] References Cited

U.S. PATENT DOCUMENTS 3,651,253 3/1972 Morgand et al. ..... 340/720
4,296,476 10/1981 Mayer et al. ..... 340/723
4,338,597 7/1982 Steiner et al. ..... 340/814
4,574,279 3/1986 Roberts ..... 340/731
4,725,833 2/1988 Nakamura ..... 340/793

*Primary Examiner*—Gerald Brigance
*Assistant Examiner*—Jeffery A. Brier
*Attorney, Agent, or Firm*—Banner, Birch, McKie & Beckett

[57] ABSTRACT

The logic signals (S0, S1, S2, HL) which define the pixel are combined together with the synchronization signals (HS, VS) by a composer circuit (19) disposed in the display control, to form a single composite signal. The composer circuit (19) is connected by way of a single conductor (21) to a separator circuit (29) for separating the synchronizing signal, disposed in the VDU control circuit (20). The VDU control circuit comprises horizontal and vertical deflection circuits (27, 43 and 28, 44) for a CRT (24) and further comprises a format selector circuit (30) which is capable of sensing the duration of the vertical synchronizing pulse to control the frequency of the video signal vertical deflection circuit (28, 44).

5 Claims, 4 Drawing Sheets

ARRANGEMENT FOR THE DISPLAY OF PROCESSING DATA BY MEANS OF PIXELS ON A CATHODE RAY TUBE

BACKGROUND OF THE INVENTION

The present invention relates to an arrangement for the display of processing data by means of pixels on a cathode ray tube (CRT) comprising a circuit for control of the CRT including means for horizontal and vertical deflection of the signal of the pixel on the tube to provide for scanning of the CRT and comprising a control means operable to generate a plurality of first logic signals which define the pixel to be displayed, the control means including means operable to generate at least two further logic signals which define synchronisation of the first logic signals with scanning of the tube effected by the deflection means.

In data processing equipment, the signal for control of the video display unit (VDU) is defined by a plurality of logic signals generated by the video control. In the case of a monochromatic VDU, in which the pixels are defined by a combination of signals representative of various base colours, the logic signals generally comprise the signals of such colours, a luminance control signal and a group of signals for defining, in dependence on the degree of resolution or display mode, horizontal and vertical synchronisation of deflection of the electron beam over the screen of the video.

Since the VDU is generally separate or can be separated from the data processing equipment, for example a personal computer, in the known arrangements the control for the VDU, which is disposed in the computer, is interfaced with the circuit for deflection control and control of the electron beam, which is disposed in the VDU, by means of a bus which carries in parallel mode the individual signals for defining the pixel. However such an interface is sensitive in operation and expensive to produce, especially when the VDU is connected to the computer by means of a cable of significant length.

SUMMARY OF THE INVENTION

The object of the present invention is to provide a display arrangement in which the connection between the control unit and the video control circuit is of the utmost simplicity and reliability in operation and is economical to produce. That problem is solved by the display arrangement of the above type, wherein we now provide a signal composer circuit operable to combine the first logic signals with the further logic signals to create a single composite signal, a synchronisation separator circuit being provided for separating the synchronisation signals from the composite signal, for controlling the deflection means.

BRIEF DESCRIPTION OF THE DRAWINGS

A preferred embodiment of the invention is illustrated by way of non-limiting example in the following description and the accompanying drawings in which.

DESCRIPTION OF THE PREFERRED EMBODIMENT

Figure 1:
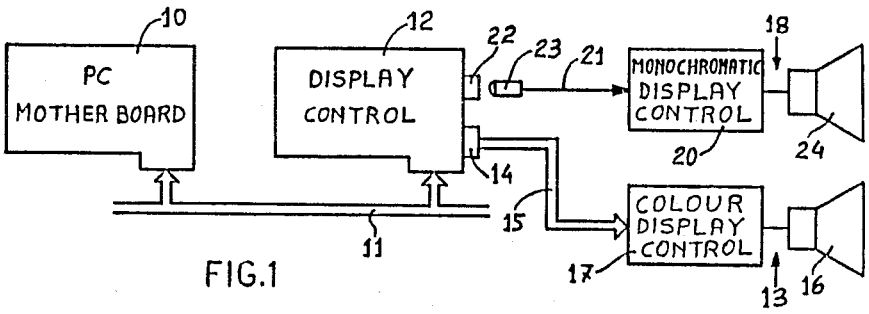
FIG. 1 is a diagrammatic outline view of a display arrangement according to the invention, connected to a personal computer.

Referring to FIG. 1, reference numeral 10 generally indicates the usual mother board of a personal computer, on which is disposed the central processing unit (CPU) together with the working memory (RAM) and the read only memory (ROM). The mother board 10 is normally connected by means of a bus 11 to the boards of the circuits for controlling a series of input and output peripheral units.

In particular connected to the bus 11 is a board 12 which carries the circuit for controlling the usual VDU 13. Normally the control 12 comprises one or more interfaces 14, to each of which a corresponding VDU 13 can be connected by means of a cable 15. The VDU 13 comprises a cathode ray tube 16 and a control circuit 17 which is operable to generate the control signals and the signals for deflection of the beam of the tube 16.

In particular the control 12 comprises buffers for the data and the images to be displayed, a video refresh memory, a ROM for generating characters, which can be addressed by means of the code of the characters, a table for selection of the base colours and a cathode ray tube control circuit (CRTC) capable of sequentially generating the signals for defining each point to be displayed on the screen (pixel). Each pixel is normally defined by a plurality of logic circuits of which at least one is provided for defining the brightness of the pixel while generally speaking three separate logic signals are generated for defining the colour of the pixel.

The control 12 further comprises means operable to generate two logic signals for horizontal and vertical synchronising of the emission of the signals of the pixel, with scanning of the tube. The signals of the pixel and the synchronising signals are normally transmitted in parallel mode from the interface 14 to the circuit 17 by means of the above-mentioned cable 15.

The CRT 16 may be of the colour or monochromatic type. In the former case the logic signals in respect of the pixel individually control the electron beams of the tube 15 of the associated colours. In the latter case the logic signals are combined to generate a scale of grey pixels corresponding to the combinations of the base colours.

In accordance with the invention the control 12 comprises a composer circuit 19 (see FIG. 2) which is capable of composing the logic signals which define the pixel and the synchronising signals, as a single composite analog control signal, for which purpose the circuit 19 essentially comprises a digital-analog (D/A) converter. The composite signal is thus transmitted to a VDU 18 comprising a simplified video control circuit 20 (see FIG. 1), by means of a cable 21 formed by a single conductor, and a monochromatic CRT. In particular the composite signal is emitted by way of an interface 22 of telephone type, that is to say a jack into which can be fitted a phone plug 23 connected to the end of the cable 21.

The video control circuit 20, as will be seen in greater detail hereinafter, is capable of separating a synchronising signal from the composite signal and providing for direct control of the monochromatic CRT 24 on the basis of the composite signal which is suitably amplified. By virtue of the complexity in respect of decoding of a possible composite signal to produce the colour of the pixel, the control 12 is however provided with the parallel interface 14 which can be used for conventional connection to a colour VDU 13.

The circuit 20 (see FIG. 2) essentially comprises a stabilised power supplier 25 which is capable of supplying the usual high voltage transformer 26 required to supply the CRT 24. The circuit 20 further comprises a horizontal deflection circuit 27 which is capable of performing all the functions necessary to transform a horizontal synchronising signal H in such a way as to cause a horizontal deflection yoke 43 to generate a power signal for producing the respective horizontal deflection of the electron beam of the CRT 24. In particular the circuit 27 may be formed by the integrated circuit TDA 2593 marketed by Thompson-CSF Components.

The circuit 27 is also operable to generate at the end of each scanning line a signal P which controls a vertical deflection circuit 28. The circuit 28 is operable to perform all the functions necessary to transform that signal in such a way as to cause a vertical deflection yoke 44 to generate a corresponding power signal to provide for vertical deflection of the electron beam of the CRT 24. The circuit 28 may be formed for example by the integrated circuit TDA 1170 marketed by Thompson-CSF Components.

Finally the circuit 20 comprises a circuit 29 which is capable of receiving the composite signal by way of the cable 21 and separating the synchronising signal therefrom in such a way as to control the horizontal deflection circuit 27. The latter in turn, by way of the signal P, controls both the vertical deflection circuit 28 and a mode selection circuit 30. As will be seen in greater detail hereinafter, the circuit 30 is capable of defining the format, that is to say the vertical resolution and thus the number of lines of pixels on the display 24. For example, the system provides for the CRT 24 a display mode in accordance with a first format consisting of 640×400 pixels, or in accordance with another format consisting of 640×350 pixels. The mode selection circuit 30 is also connected to a circuit 31 for regulating the frame size.

The single video control signal which is separated from the synchronising signal is now passed to a video signal amplifier and regulator 32 which can be connected to manual controls 33 by means of which the user can adjust the brightness and the contrast of the pixels displayed, in known fashion. The output of the amplifier 32 is applied to a final video signal amplifier 34 which is connected to the cathode 35 of the CRT 24.

Figure 3:
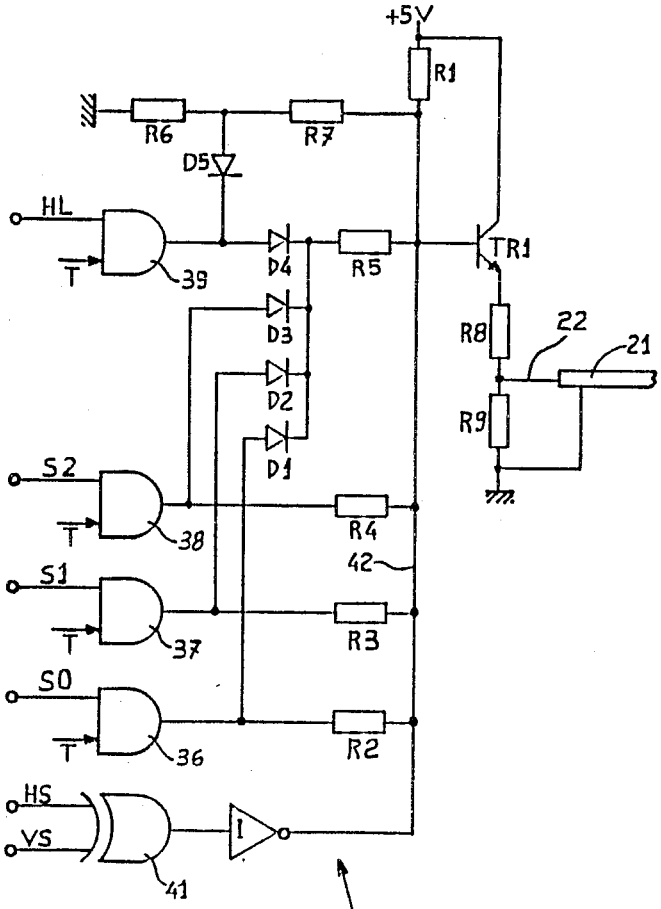
FIG. 3 shows a detail of the composer circuit for the output signals of the video control.

The video control 12 produces three logic signals S0, S1 and S2 which are representative of the three fundamental colours for a colour VDU and which are representative of the corresponding grey tones for a monochromatic VDU, the three signals S0, S1 and S2 defining eight different grey levels in binary code. The three signals S0, S1 and S2 are applied to the inputs of three AND-gates 36, 37 and 38 which are included in the circuit 19 (see FIG. 3) and which are enabled by a clock signal T at a frequency of 24.00 MHz.

Figure 6:
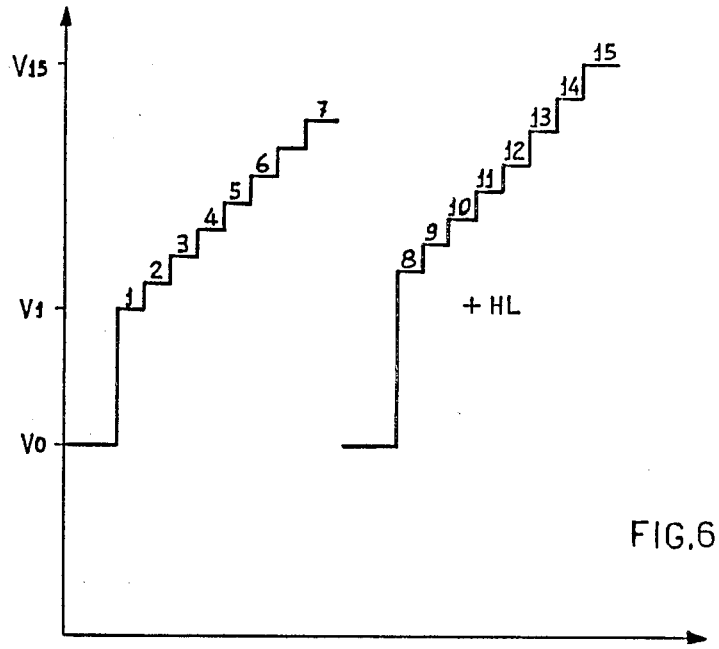
FIG. 6 is a diagram illustrating the levels of the control signals.

The control 12 (see FIG. 2) also produces a logic signal HL capable of selectively defining two brightness levels so that in combination with the three signals S0, S1 and S2 it is possible to produce the eight grey tones, each with two different levels of brightness (FIG. 6). The signal HL is applied to an input of another AND-gate 39 (see FIG. 3) of the circuit 19, which gate is enabled by the signal T.

Finally the control 12 (see FIG. 2 ) produces two logic horizontal and vertical synchronising signals HS and VS respectively for defining scanning of the CRT, those signals being applied to the two inputs of a XOR-gate 41 (see FIG. 3) of the circuit 19. The output of the XOR-gate 41 is connected to an inverter I which outputs a synchronising signal. The output of the inverter is connected to a node in which the composite signal is formed. The node 42 is in turn connected to the supply voltage +5V by means of a resistor R1 such that the synchronising signal is of a magnitude V0=350 mV (FIG. 6).

The outputs of the three AND-gates 36, 37 and 38 (FIG. 3) are each connected to the node 42 by means of a corresponding resistor R2, R3 and R4. The resistors are of such a size as individually to supply three voltage levels corresponding to the respective grey levels, the binary values of which are 1, 2 and 4. Collectively the three voltages can thus provide eight grey levels as indicated by 0 to 7 (see FIG. 6).

As is known, the brightness of the tube of the video unit 24 is not proportional to the control voltage but follows a configuration of parabolic type. The three resistors R2, R3 and R4 (see FIG. 3) may advantageously be so selected as to correct the linearity of the brightness of the greys at the tube of the video unit 24. For example, the following values may be used for the three resistors: R2=6.2 kohm, R3=3 kohm and R4=1.5 kohm.

The outputs of the three AND-gates 36, 37 and 38 are also each connected to a corresponding diode D1, D2 and D3 while the output of the AND-gate 39 is connected to a diode D4. The four diodes D1–D4 are connected to the node 42 by means of a resistor R5 to produce a pull-up function in respect of the voltage at a value of +5V in the node. The circuit 19 is such as to impart a predetermined magnitude V1 (see FIG. 6) to the grey level 1, for example being such that, after the amplification operation described hereinafter, it is around 250 mV, thus clearly distinguishing the condition in which a composite signal is absent from a condition in which a composite signal is present. The difference between the voltages of the successive steps V1–V7 on the other hand is of the order of 50 mV.

Finally the output of the AND-gate 39 (see FIG. 3) is connected to the resistor R1 by way of a second diode D5 and a voltage divider formed by two resistors R6 and R7. Those resistors are such that, as long as the signal HL is low, no signal can pass through the diode D4 while, if HL is high, a signal passes by way of the diode D4, that signal producing an additional voltage in the node 42. It is therefore thus possible to define a second scale of greys from 8 to 15 (see FIG. 6). The control signal which results at the interface 22 from composition of the signals S0, S1, S2 and HL, after the amplification operation described thereinafter, varies from 250 mV to 700 mV. The composite signal resulting from the sum with the synchronising signal however varies from 600 mV to 1050 mV.

The composite signal created at the node 42 is transferred to the cable 21 by way of a transistor TR1 which has its base connected to the node 42 and its collector connected to the +5V voltage. The emitter of the transistor TR1 is connected to the interface 22 of the cable 21 by way of a voltage divider R8 and R9 such as to match the impedance of the circuit to that of the cable 21.

Figure 4:
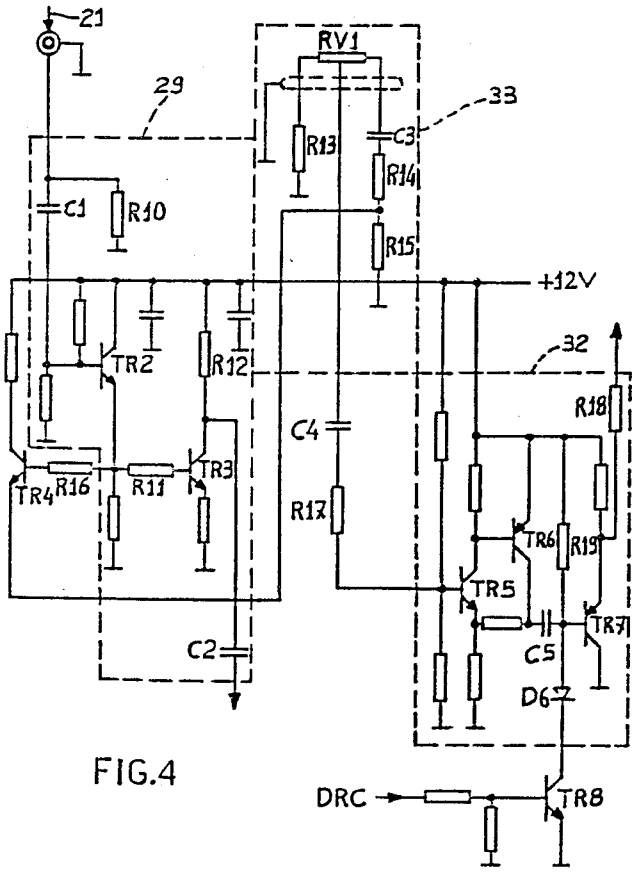
FIG. 4 is a detail of the separator circuit for separating the sync signals of the video control circuit.

The separator circuit 29 (see FIG. 4) comprises a resistor R10 which matches the input impedance of the circuit 29 and a capacitor C1 which couples the ac composite signal to the base of an emitter follower TR2. The latter is connected by way of a resistor R11 to the base of a transistor TR3 connected by way of a resistor R12 to the +12V power supply.

Figure 2:
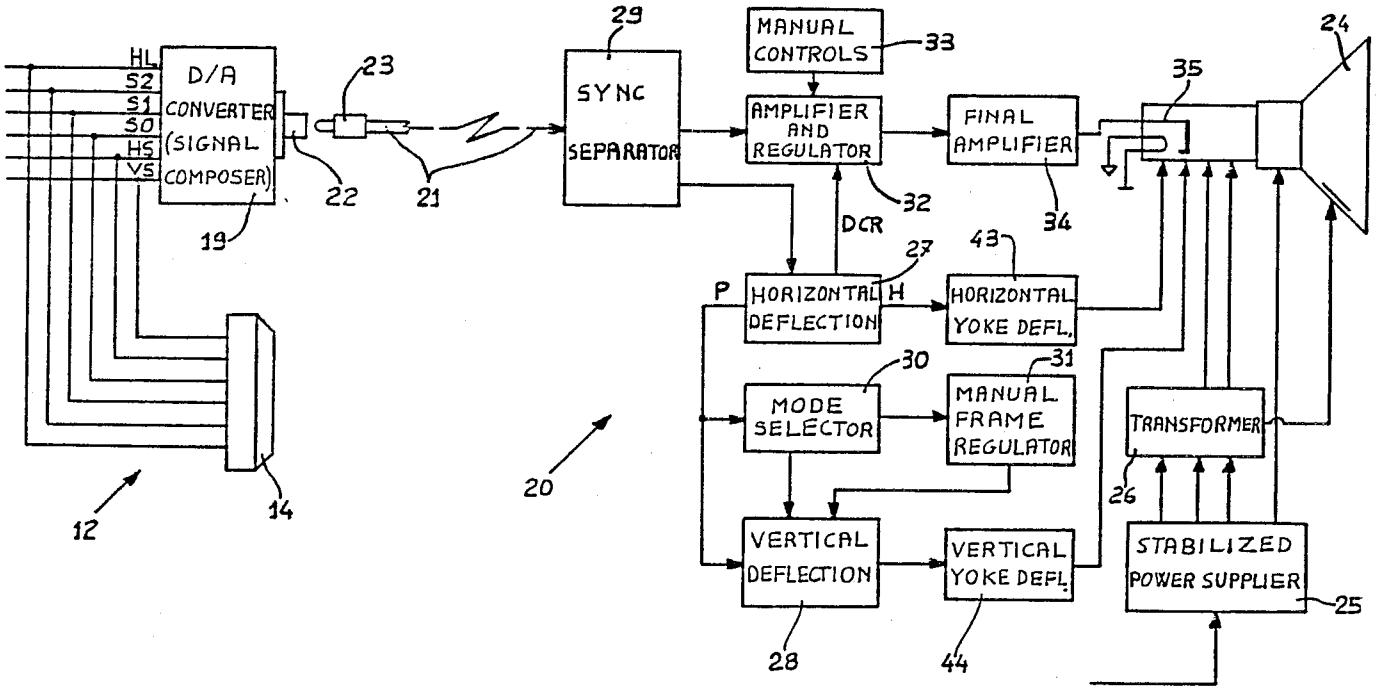
FIG. 2 is a block circuit diagram of the display arrangement according to the invention.

The collector of the transistor TR3 is in turn connected by way of a capacitor C2 to the horizontal deflection circuit 27 (see FIG. 2). The capacitor C2 thus removes the synchronising component from the composite signal, the former being passed to the circuit 27.

The control circuit 33 (see FIG. 4) comprises a network formed by a capacitor C3, two resistors R13 and R14 and a variable resistor RV1 which is regulated by means of external control to vary the magnitude of the video signal, thus varying the contrast on the video unit. The resistor R14 is part of a voltage divider R14 and R15 connected to the emitter of another emitter follower TR4 whose base is connected by way of a resistor R16 to the emitter of the emitter follower TR2.

The output signal of the circuit 33 is coupled by way of a capacitor C4 in series with a resistor R17 to the amplifier 32 which is of the wide-band type and comprises two transistors TR5 and TR6. The output of the two transistors TR5 and TR6 is connected by way of another capacitor C5 to the base of an emitter follower TR7 whose emitter gives the video signal. That signal is finally applied to the final amplifier of the CRT 24 (see FIG. 2), by way of a resistor R18.

The base of the emitter follower TR7 (see FIG. 4) is connected by way of a resistor R19 to the voltage +12V, and by way of a diode D6 to the collector of a transistor TR8. The latter is closed by a pulse DCR coming from the horizontal deflection circuit 27 (see FIG. 2) during the return of each horizontal scanning in such a way as to fix the plate of the capacitor C5 (see FIG. 4) at a constant potential, thus providing for stability in respect of the level of the black signal for the video unit.

As already indicated above, the CRT 24 (see FIG. 2) can operate in accordance with a format or mode of 640×400 or in accordance with a mode of 640×350. The composite signal received by the circuit 29 comprises two synchronising signals, being a horizontal synchronising signal 46 and a vertical synchronising signal 47 respectively (see FIG. 7). The signal 46 (see FIG. 7) is at a frequency of about 26 KHz which is constant for the two formats and comprises a portion of duration T1 of around 27 μsec during which the signals in respect of the pixels of the line are generated, and a portion of a duration T2 of around 34 μsec which is active for scanning of the entire line. At each horizontal fly back, a pulse of a duration T3 of around 4.5 μsec is produced. The total time for scanning a line, as indicated at T4, is therefore about 38.5 μsec.

However the signal 47 depends on the display format preselected by the central unit 10. In the case of the format consisting of 400 lines, the signal 47 is of a frequency of around 60 Hz and comprises a portion of a duration T5 of around 15.5 msec in which the signals H are generated and a portion of a duration T6 of around 16.6 msec which is active for scanning of the entire frame. In each vertical fly back, a pulse of a duration T7 of around 116 μsec is created, so that T7=3×T4. The total time for scanning the frame, as indicated at T8, is therefore around 16.7 msec.

Figure 7:
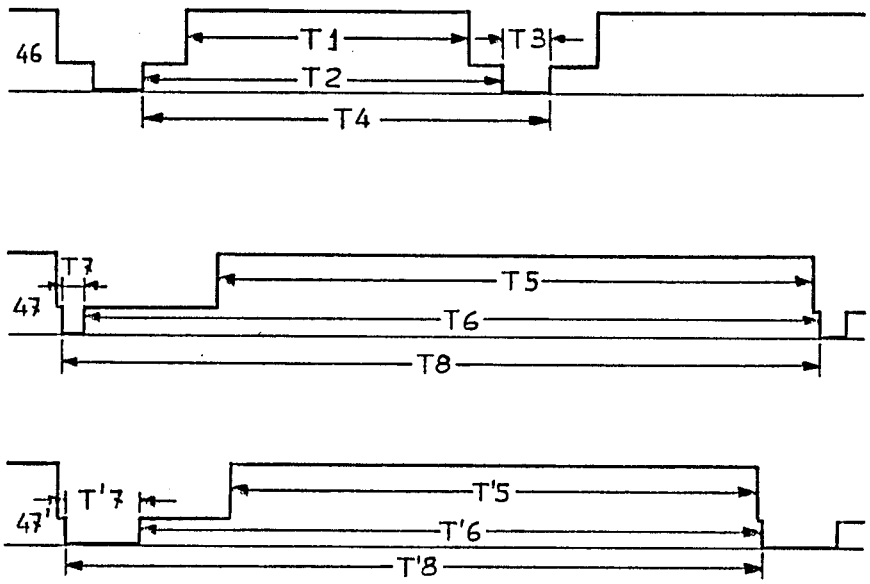
FIG. 7 is a diagram illustrating the timing of the video control signals.

In the case of the 350 line format however the vertical synchronising signal which is indicated at 47′ in FIG. 7 is at a frequency of around 68 Hz and comprises a portion of a duration T′5 of around 13.5 msec and a portion of a duration T′6 of around 14.8 msec and creates a fly back pulse T′7=513 μsec, so that T′=13×T4. The frame scanning time T′8 is now 14.7 msec. After removal of the 350 mV synchronising signal, which is effected by the circuit 29 (see FIG. 2), the circuit 27 generates the signal H which is of a duration equal to T3 and the signal P which is of a duration equal to T7 of T′7, depending on the format.

Figure 5:
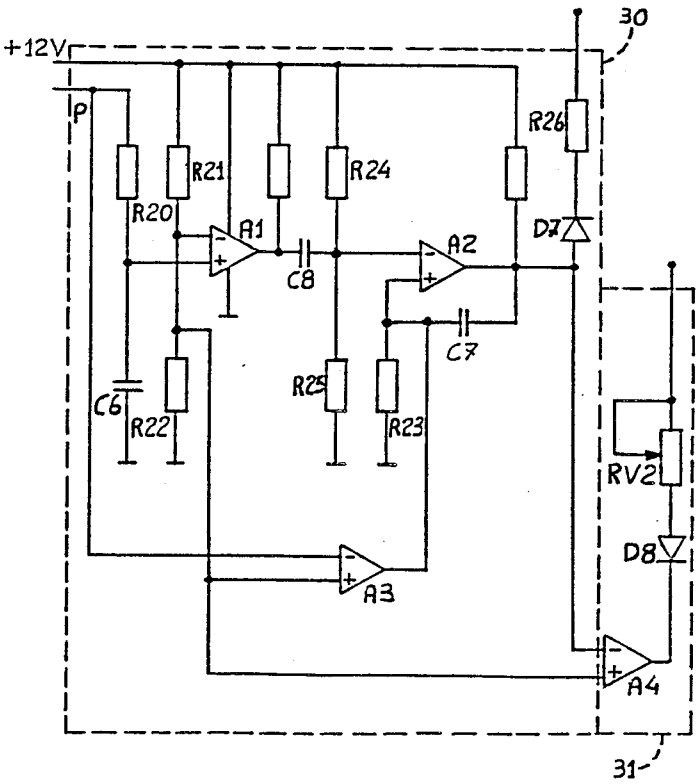
FIG. 5 shows a video mode selection control circuit.

The selection circuit 30 (see FIG. 2) is capable of sensing the duration of the signal P supplied by the circuit 27 for correspondingly controlling the vertical deflection circuit 28. The latter is normally operable to provide for vertical deflection at a frequency corresponding to the video format of 400 lines. In order to switch that frequency over to the frequency corresponding to the video format of 350 lines, the circuit 30 (see FIG. 5) comprises an integrator formed by a resistor R20 and a capacitor C6, which integrates the pulse P supplied by the circuit 27 (FIG. 2). The integrator R20, C6 is operable to produce a voltage of 2V in the case of the 400 line format and a voltage of 8V in the case of the 350 line format. That voltage is applied to an input of an operational amplifier A1 whose other input is connected to a reference voltage divider R21, R22. In the case of the voltage of 8V, the amplifier A1 outputs a voltage of +12V while in the case of the voltage of 2V, that output remains blocked.

The circuit 30 further comprises a multivibrator formed by another amplifier A2 and a circuit R23, C7. The period of that univibrator is about 25 msec, that is to say greater than the 400 line frame scanning time T8. An input of the amplifier A2 is connected by way of the capacitor C8 and a voltage divider R24, R25 to the output of the amplifier A1. The other input of the amplifier A2 is triggered by a third amplifier A3 which receives the pulse P and the reference signal from the voltage divider R21, R22 whereby the multivibrator A2, R23, C7 is continuously triggered. The output of the amplifier A2 is connected by means of a diode D7 and a resistor R26 to an input of the circuit 28 (FIG. 2). When the output of the amplifier A1 is at +12V, the output of the amplifier A2 supplies the circuit 28 with a commmand such as to vary the frequency of vertical deflection in such a way as to produce the 350 lines of the frame.

The visual frame size regulating circuit 31 essentially comprises an operational amplifier A4 (see FIG. 5) which operates as an inverting gate. An input of the amplifier A4 is connected to the voltage divider R21, R22 while the other input is connected to the output of the amplifier A2. The output of the amplifier A4 is connected by way of a diode D8 to a second variable resistor RV2 which is connected to another input of the circuit 28 and is regulated at the time of setting up the apparatus for regulating the magnitude of vertical deflection and thus the size of the visual frame of the video in the 350 line format.

It will be appreciated that the above-described arrangement may be the subject of various additions, modifications and improvements without departing from the scope of the invention. For example parts of the circuits described may be integrated in one or more chips. In particular the two circuits 30 and 31 may be formed by the integrated circuit LM 339 marketed by TEXAS INSTRUMENT.

We claim:

1. Arrangement for the display of processing data by means of pixels on a cathode ray tube—CRT—comprising a circuit for control of the CRT including means for horizontal and vertical deflection of the signal of the pixel on the tube to provide for scanning of the CRT and comprising a control means operable to generate a plurality of first logic signals which define the pixel to be displayed, the control means including means operable to generate at least two further logic signals which define synchronization of the first logical signals with scanning of the tube effected by the deflection means, and a signal composer circuit operable to combine the first logic signals into a single control signal, characterized in that the composer circuit is operable to combine in the control signal also the further logic signals to create a single composite signal, a synchronization separator circuit being provided for separating the synchronization signals from the composite signal, for controlling the deflection means, wherein the display may be produced in accordance with at least two different resolution formats, characterized in that the separator circuit is operable to control format selection means in such a way as to control deflection of the pixel signal on the tube in accordance with the selected format.

2. Arrangement according to claim 1, wherein the formats differ in regard to the number of tube scanning lines, the control means being operable to generate in each case a vertical synchronizing signal of a frequency corresponding to the format characterized in that the selection means comprise means which are sensitive to the duration of the vertical synchronizing signal to vary the control frequency of the pixel signal vertical deflection circuit.

3. Arrangement according to claim 2, characterized in that the sensitive means comprise a pulse integrator and an operational amplifier which is operable to discriminate at least two levels of integrated signal to generate a corresponding control pulse.

4. Arrangement according to claim 3, characterized in that the sensitive means comprise a multivibrator capable of being triggered by the control pulse.

5. Arrangement according to claim 3 or 4 characterized in that the selection means are also connected to a video size regulating circuit capable of being actuated to regulate the magnitude of deflection of the vertical deflection circuit.

* * * * *